US005174265A

United States Patent [19]

Sekine

[11] Patent Number: 5,174,265

[45] Date of Patent: Dec. 29, 1992

[54] CANISTER SYSTEM

[75] Inventor: Hidetoshi Sekine, Kiryu, Japan

[73] Assignee: Fuji Jukogyo Kabushiki Kaisha, Tokyo, Japan

[21] Appl. No.: 828,209

[22] Filed: Jan. 30, 1992

[30] Foreign Application Priority Data

Feb. 18, 1991 [JP] Japan ..... 3-013079[U]

[51] Int. Cl.[5] ..... F02M 33/02

[52] U.S. Cl. ..... 123/520; 123/516

[58] Field of Search ..... 123/516, 518, 519, 520, 123/521, 198 D

[56] References Cited

U.S. PATENT DOCUMENTS

| | | | |
|---|---|---|---|
| 4,527,532 | 7/1985 | Kasai et al. | 123/520 |
| 4,630,581 | 12/1986 | Shibata | 123/519 |
| 4,641,623 | 2/1987 | Hamburg | 123/518 |
| 4,700,683 | 10/1987 | Uranishi | 123/520 |
| 4,702,216 | 10/1987 | Haruta | 123/520 |
| 4,815,436 | 3/1989 | Sasaki | 123/520 |
| 4,951,643 | 8/1990 | Sato | 123/520 |
| 5,085,197 | 2/1992 | Mader | 123/518 |

*Primary Examiner*—Carl S. Miller

*Attorney, Agent, or Firm*—Beveridge, DeGrandi & Weilacher

[57] ABSTRACT

A bypass pipe 10 which bypasses the first and second check valves 13*a*, 13*b* of an air breather pipe 8 for the communication between the upper space of a fuel tank 3 and an absorbent 2 contained in a canister 1 is disposed including a first change-over valve 12*a* which is opened only during the operation of a motor vehicle, while that second vent pipe 16 of the canister 1 which is openable to the atmosphere is furnished with a second change-over valve 12*b* which enlarges a ventilating cross-sectional area only during the operation of the vehicle. During the running of the vehicle, accordingly, the second vent pipe 16 is opened, and the first and second check valves 13*a*, 13*b* interposed in the air breather pipe 8 are invalidated to bring the fuel tank 3 and the canister 1 into direct communication.

2 Claims, 2 Drawing Sheets

CANISTER SYSTEM

BACKGROUND OF THE INVENTION

1. Field of the Invention

The present invention relates to a canister which serves to prevent fuel vapor, generated in the fuel tank of a motor vehicle, from diffusing into the atmosphere. More particularly, it relates to a canister which prevents fuel vapor from diffusing into the atmosphere even in a case where the fuel vapor has increased in excess of the adsorbing capability of the canister during the running of a motor vehicle.

2. Description of the Prior Art

In general, fuel for use in a motor vehicle is highly volatile, so that it vaporizes in a fuel tank under heat from the engine and other parts of the vehicle during the drive of the vehicle or the stop thereof after the drive. When the fuel vapor has diffused into the atmosphere, the atmospheric air is polluted with hydrocarbons contained in the fuel. Therefore, a canister as shown in FIG. 3 has heretofore been used for preventing the diffusion of the fuel vapor into the atmosphere and for recycling the vaporized fuel.

With this prior-art technique, fuel vapor, generated in a fuel tank 3 when the drive of a motor vehicle has stopped, passes through an air breather pipe 8 and then through an adsorbent 2 contained in a canister 1 and comes into communication with the atmosphere owing to a vent pipe 15. On this occasion, the fuel component of the fuel vapor is absorbed to the adsorbent 2, and only purified air is emitted into the atmosphere.

Besides, while the vehicle is being driven, a negative pressure is developed in the suction system 4 of an engine by the opening of a throttle valve 5, and the fuel adsorbed to the adsorbent 2 is vaporized and is recycled into the suction system 4 through a suction pipe 9 by the negative pressure, to become part of the fuel of the vehicle. Midway of the air breather pipe 8, there are interposed in parallel a first check valve 13*a* which is opened when the pressure of the upper space of the fuel tank 3 has risen to a predetermined value, thereby to release the pressure, and a second check valve 13*b* which is opened when the pressure of the upper space has lowered to a predetermined value, thereby to introduce the atmospheric pressure. It is also known that, in a case where the fuel has a low vapor pressure and vaporizes slightly, the first check valve 13*a* cuts off the air breather pipe 8, thereby functioning to prevent the fuel vapor from being wastefully adsorbed to the adsorbent 2 (refer to the official gazette of Japanese Patent Application Laid-open No. 53451/1986).

With the prior-art technique, in principle, the fuel vapor is adsorbed at the stop of the drive of the motor vehicle and is recycled during the drive. The fuel vaporizes during the drive more than at the stop of the drive on account of the influences of heat and vibrations. During the drive, however, the fuel is recycled through the suction pipe 9, with the result that it seems to be recycled entirely.

In recent years, however, vehicular engines have become high in performance and high in power owing to the addition of a turbosupercharger, the adoption of a fuel injection system based on an electronic control, etc., whereas the ambient temperatures of the engines have heightened. Therefore, the temperature of the fuel during the drive tends to rise, and the amount of vaporization of the fuel increases. Especially in case of high-speed running, there arises a situation where the check valve 13*a* is almost held open, so the fuel vapor cannot be entirely recycled, and where the adsorbing capability of the adsorbent 2 is exceeded, so the fuel vapor is emitted into the atmosphere.

In order to improve this situation, it is thought out that the recycling capability of the canister is enlarged by thickening the suction pipe 9. However, when the suction pipe 9 is thickened, inconveniently the mixture of the engine becomes lean during the idling of the engine and the low-speed running of the vehicle. Moreover, enlargement in the capacity of the canister is spatially disadvantageous and is costly. Another problem is that the adsorption of the fuel cannot be continued when the high-speed running has been continued for a long time.

SUMMARY OF THE INVENTION

The present invention has been made in order to solve the problems stated above, and has for its object to provide a canister which recycles fuel vapor completely in cases of high-speed running etc. and which exerts no bad influence on the mixture of an engine.

In one aspect of performance of the present invention, there is provided a canister for adsorbing fuel vapor generated in a fuel tank mounted on a motor vehicle having, an adsorbent contained in said canister for adsorbing fuel from said fuel vapor, an air breather pipe connected between an upper portion of said fuel tank and said adsorbent, a vent pipe connected to said canister for discharging purified air to atmosphere, check valve means interposed in said vent pipe for preventing said fuel vapor from returning into said fuel tank, and an air pipe connected between an upper portion of said canister and a throttle valve for recycling said fuel into an induction pipe of an engine, the improvement of the canister which comprises a bypass pipe provided in parallel with said air breather pipe for bypassing said check valve means; an additional vent pipe provided in parallel with the first-mentioned vent pipe under said canister for further improving the discharge of said air from said canister; a first three-way valve interposed in said bypass pipe for automatically opening a first port when a negative pressure is applied from the suction pipe; a second three-way valve interposed in said additional vent pipe for automatically opening a second port when said negative pressure is applied from said suction pipe; and a negative pressure pipe connected between said first and second ports and an upstream portion of said throttle valve for further inducing said fuel vapor into said engine when said vehicle is operating, so as to effectively adsorb said fuel vapor in said fuel tank and to prevent said fuel vapor from discharging largely into said atmosphere.

On the basis of the above construction, in the state in which the automobile is at a stop, the bypass pipe which bypasses the check valve means disposed midway of the air breather pipe is held closed by the first three-way valve, and that additional vent pipe of the canister which is open to the atmosphere does not have its cross-sectional area enlarged because the second three-way valve is closed. In this state, accordingly, the canister of the present invention is functionally quite the same as the prior-art canister shown in FIG. 3, and the fuel vapor generated in the fuel tank is adsorbed by the canister on condition that the pressure thereof is the set pressure of the check valve means or above.

On the other hand, during the operation of the automobile, the first three-way valve for opening the bypass pipe bypassing the check valve means located midway of the bypass pipe and the second three-way valve for enlarging the cross-sectional area of the additional vent pipe of the canister are both opened by the negative pressure applied from the suction system of the engine. Therefore, the first and second check valves are short-circuited and invalidated by the bypass pipe, and the cross-sectional area of the additional vent pipe is enlarged. In this state, the air breather pipe has no resistance, so that the pressure in the fuel tank lowers, and the fuel vapor enters the canister rather more than at the stop of the operation of the vehicle. Since, however, the cross-sectional area of the additional vent pipe of the canister is simultaneously enlarged, a large amount of air is introduced into the suction system of the engine while vaporizing the fuel component adsorbed to the adsorbent in the canister. Accordingly, the cross-sectional area of the additional vent pipe is not merely enlarged to introduce the large amount of air into the suction system of the engine, but the fuel vapor corresponding to the increased amount of air is introduced bypassing the check valve means. Therefore, the mixture of the engine is not adversely affected, and the fuel vapor is prevented from diffusing into the atmosphere without being recycled completely.

PREFERRED EMBODIMENT OF THE INVENTION

Figure 1:
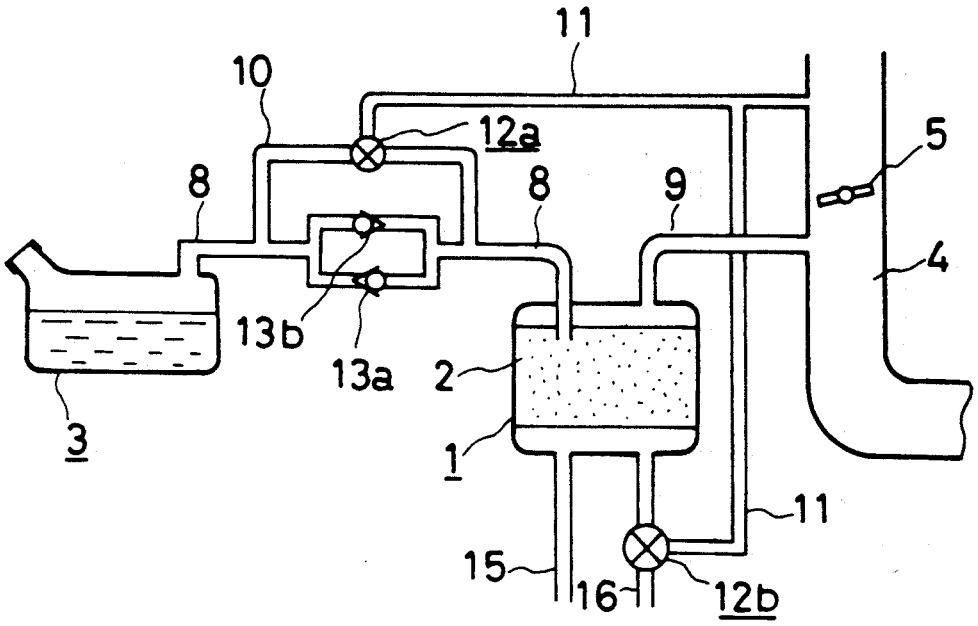
FIG. 1 is a constructional view showing an embodiment of the present invention.
Figure 3:
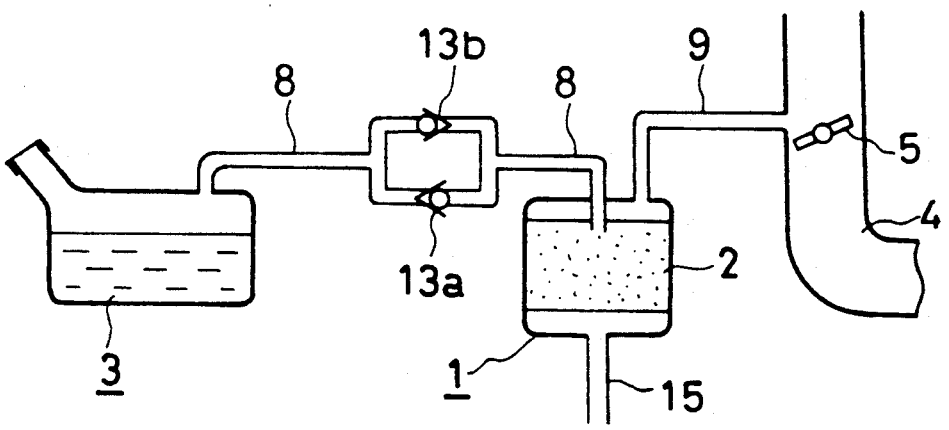
FIG. 3 (PRIOR ART)
FIG. 3 is a view showing a prior-art example.

Now, an embodiment of the present invention will be described with reference to the drawings. FIG. 1 shows the embodiment of the present invention, in which constituents corresponding to those of the prior-art technique in FIG. 3 have the same symbols assigned thereto.

An air breather pipe 8 in which first and second check valves 13*a*, 13*b* are interposed is disposed between the upper space of a fuel tank 3 and an adsorbent 2 contained in a canister 1, while a suction pipe 9 is disposed between the upper space of the canister 1 and the suction system 4 of an engine. In addition, a first vent pipe 15 communicating with the atmosphere is provided under the canister 1. The above construction is the same as in the prior-art technique illustrated in FIG. 3.

Here in the present invention, a bypass pipe 10 which bypasses the first and second check valves 13*a*, 13*b* provided in the air breather pipe 8 is existent with a first change-over or three-way valve 12*a* interposed therein, while a second vent pipe 16 is existent besides the first vent pipe 15 under the canister 1 with a second change-over or three-way valve 12*b* interposed therein.

The first and second change-over valves 12*a*, 12*b* are structurally the same. However, the openable cross-sectional area of the first change-over valve 12*a* is smaller than that of the second change-over valve 12*b*, and the cross-sectional areas of these valves 12*a*, 12*b* correspond respectively to the diameters of the bypass pipe 10 and the second vent pipe 16. Both the first and second change-over valves 12*a* and 12*b* are actuated by a negative pressure pipe 11. Concretely, when a negative pressure is developed in the suction system 4 of the engine by the operation of the engine, it is applied by the negative pressure pipe 11 connecting the suction system 4 with the first and second change-over valves 12*a*, 12*b*, and these first and second change-over valves 12*a*, 12*b* are opened.

Figure 2:
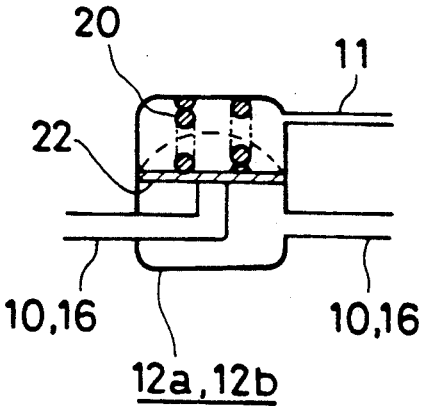
FIG. 2 is a sectional view for explaining three-way valves.

FIG. 2 is a sectional view showing each of the first and second change-over valves 12*a*, 12*b* in the state in which the negative pressure is not applied. A diaphragm 22 partitions the change-over valve into two, upper and lower chambers, and it is normally urged downwards by a spring 20, thereby to close up the distal end of the bypass pipe 10 or the second vent pipe 16. When the upper chamber partitioned by the diaphragm 22 is subjected to the negative pressure from the negative pressure pipe 11, the diaphragm 22 rises or bulges against the force of the spring 20 as indicated by a broken line in FIG. 2. Accordingly, the distal end of the bypass pipe 10 or the second vent pipe 16 is opened, and the parts of the bypass pipe 10 or the second vent pipe 16 holding the change-over valve therebetween come into communication as depicted in FIG. 2.

The embodiment of the present invention is as described above. Therefore, in the state in which the negative pressure is not applied to the first and second change-over valves 12*a*, 12*b* because of the stop of the engine, the bypass pipe 10 and the second vent pipe 16 are cut off to perform no function. Accordingly, the embodiment is substantially the same in construction as the prior-art example shown in FIG. 3, and the fuel vapor generated in the fuel tank 3 is passed through the first and second check valves 13*a*, 13*b* and is adsorbed to the adsorbent 2 in the canister 1.

On the other hand, in the state in which the engine is operating, the negative pressure is exerted on the first and second change-over valves 12*a*, 12*b* via the negative pressure pipe 11, and both the first and second change-over valves 12*a*, 12*b* are opened, so that each of the bypass pipe 10 and the second vent pipe 16 is brought into communication. Accordingly, the first and second check valves 13*a*, 13*b* are invalidated, and the upper space of the fuel tank 3 and the adsorbent 2 in the canister 1 come into direct communication. In addition, the second vent pipe 16 is operated to bring the lower space of the canister 1 and the atmosphere into communication with an enlarged cross-sectional area together with the first vent pipe 15.

As set forth above, according to the present invention, during the stop of an engine, the canister adsorbs fuel vapor likewise to the canister in the prior-art technique. On the other hand, during the operation of the engine, a large amount of air is fed by the canister, thereby to enhance the performance of desorbing adsorbed fuel, while first and second check valves interposed in an air breather pipe are invalidated to bring a fuel tank and the canister into direct communication, thereby to supply fuel vapor more, so that the mixture of the engine is not adversely affected. It is therefore possible to prevent a situation where, during the running of an automobile, the amount of fuel vapor becomes excessive, so that the fuel vapor is insufficiently recycled by the negative pressure of the engine and diffuses into the atmosphere.

What is claimed is:

1. A canister for adsorbing fuel vapor generated in a fuel tank mounted on a motor vehicle having, an adsorbent contained in said canister for adsorbing fuel from said fuel vapor, an air breather pipe connected between an upper portion of said fuel tank and said adsorbent, a vent pipe connected to said canister for discharging purified air to atmosphere, check valve means interposed in said vent pipe for preventing said fuel vapor from returning into said fuel tank, and an air pipe connected between an upper portion of said canister and a throttle valve for recycling said fuel into an induction pipe of an engine, the improvement of the canister which comprises:

a bypass pipe provided in parallel with said air breather pipe for bypassing said check valve means;

an additional vent pipe provided in parallel with the first-mentioned vent pipe under said canister for further improving the discharge of said air from said canister;

a first three-way valve interposed in said bypass pipe for automatically opening a first port when a negative pressure is applied from the suction pipe;

a second three-way valve interposed in said additional vent pipe for automatically opening a second port when said negative pressure is applied from said suction pipe; and a negative pressure pipe connected between said first and second ports and an upstream portion of said throttle valve for further inducing said fuel vapor into said engine when said vehicle is operating, so as to effectively adsorb said fuel vapor in said fuel tank and to prevent said fuel vapor from discharging largely into said atmosphere.

2. The canister according to claim 1, wherein said three-way valve is of diaphragm type.

* * * * *